United States Patent [19]

Graves et al.

[11] 4,352,084

[45] Sep. 28, 1982

[54] VARIABLE RESISTOR DISK ASSEMBLY

[75] Inventors: William B. Graves, Cerritos; James F. Walsh, Irvine, both of Calif.

[73] Assignee: EECO Incorporated, Santa Ana, Calif.

[21] Appl. No.: 206,593

[22] Filed: Nov. 13, 1980

[51] Int. Cl.[3] ..... H01C 10/16

[52] U.S. Cl. ..... 338/127; 338/128; 338/174

[58] Field of Search ..... 338/127, 126, 174, 172, 338/123, 185, 188, 190, 140, 157

[56] References Cited

U.S. PATENT DOCUMENTS

| | | | |
|---|---|---|---|
| 795,570 | 7/1905 | Anderson | 338/127 |
| 2,215,124 | 9/1940 | Kock et al. | 201/48 |
| 3,448,427 | 6/1969 | Baskett | 338/162 |
| 3,805,209 | 4/1974 | Keranen | 338/76 |

FOREIGN PATENT DOCUMENTS

| | | | |
|---|---|---|---|
| 212089 | 6/1924 | United Kingdom | 338/127 |

*Primary Examiner*—C. L. Albritton

*Attorney, Agent, or Firm*—Harry R. Lubcke

[57] ABSTRACT

A compact configuration of resistive elements, plural circularly-arranged fixed contacts upon, or mountable upon, a printed circuit board (PCB), to comprise a rotary variable resistor.

In one embodiment, fixed contacts are disposed upon one side of a PCB, in which through-conductors connect to a resistor pattern upon a separate ceramic substrate.

In another embodiment, fixed contacts occupy the central area, and resistors and interconnecting conductors surround the same; all on one side of a ceramic substrate.

Mutually insulated spring wipers connect to the fixed contacts to allow rotary variation of resistance.

12 Claims, 7 Drawing Figures

VARIABLE RESISTOR DISK ASSEMBLY

BACKGROUND OF THE INVENTION

This invention pertains to rotary electrical variable resistors.

Various rotary electrical variable resistors have been known.

Very early in electrical apparatus bronze switch points were connected to bobbins of resistance wire and a bronze switch arm was arranged to sweep over the switch points, which were arranged in a circle.

Later, uniform circular graphitic resistive elements were directly swept over by a switch arm.

A linear adaption of this technique is disclosed in Kock et al, U.S. Pat. No. 2,215,124, in which sliding metal fingers contact two resistor areas on a substrate, in order to give "thumpless" electric organ keying.

Keranen, in U.S. Pat. No. 3,805,209, discloses resistive elements that are fired on a substrate, but these are parts that play no active role with a switch structure. They are in coaxial attenuators that are switched as a whole in or out of a microwave coaxial transmission line.

Basket, in U.S. Pat. No. 3,448,427, discloses several related wafer resistor structures having a fixed resistor element and a companion resistor element that can be varied in resistance value by rotating one part of the structure with respect to another part.

Eyelets are used for through-wafer electrical connections. Pins may be soldered to contacts on the printed circuit board (PCB) upon which the device is mounted.

The resistive and conductive paths are essentially special-purpose and do not suggest the universal arrangement provided by the subject invention.

Immediately prior printed circuit board technique of the present inventors has placed grouped resistors away from the rotary contacts as the only way of accomplishing such a structure. This structure required a large number of relatively very long conductive paths from the resistors to the contacts and a very difficult printed circuit layout.

SUMMARY OF THE INVENTION

A compact configuration of resistive elements, circularly arranged fixed contacts, and interconnecting conductors upon a printed circuit board (PCB), for significant variable resistor applications.

In one embodiment, fixed contacts are disposed on one side of the PCB. Small holes are below each contact.

A separate substrate carries the resistive elements.

A fusible conductor, such as solder, is fused within each small hole to a fixed contact and to a companion resistive element. This binds the substrate to the PCB.

This results in a compact configuration that occupies only the area on the PCB that is required for the fixed contacts.

In another embodiment, the resistive elements, fixed contacts and interconnecting conductors are all disposed on one side of a refractory substrate.

Typically, the circularly arranged fixed contacts occupy the central area. These are surrounded by the resistive elements, with interconnecting conductors between the contacts and the resistive elements. At the periphery of the substrate additional conductors connect to appropriate fixed contacts and the inner contact rings. These additional conductors are terminated at the periphery in clip contacts. These are solderable to the remainder of the circuit on the PCB.

These structures reduce the complexity of the disposition of the elements on the PCB and give a simple PCB layout.

DETAILED DESCRIPTION OF THE PREFERRED EMBODIMENTS

Figure 1:
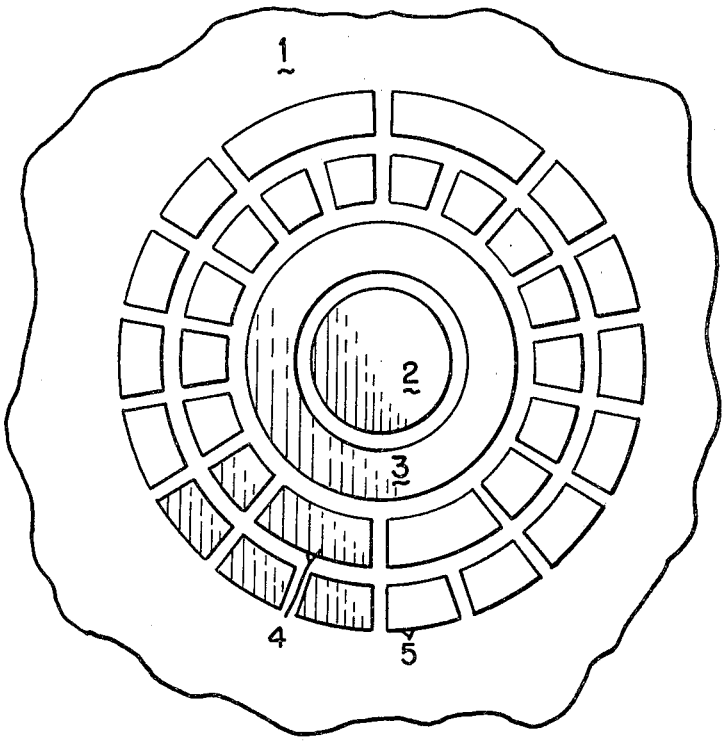
FIG. 1 is a top plan view of a printed circuit board (PCB) fragment, showing an illustrative group of circular contacts.
Figure 2:
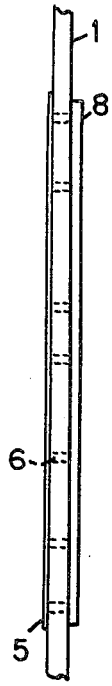
FIG. 2 is an end-on view of the assembly.

In FIGS. 1 and 2, numeral 1 identifies a known printed circuit board (PCB). In addition to other conductive circuits that might be present on other areas of the PCB (such circuits are not shown), circular and annular conductive areas pertain to the subject variable resistor.

Plural fully-circular electrically conductive contacts 2 and 3 provide the return circuit for the rotary wipers of the variable resistor. Plural rings 4 and 5 are concentric with, and surround, the fully circular contacts. Ring 4 has a number of separate contacts in the full circumference thereof. Illustratively, ring 4 has 16 contacts. Two adjacent ones are of double circumferential width. Ring 5 also has 16 contacts. Two adjacent ones are also of double width. These are diametrically removed from the equivalent contacts in ring 4.

This arrangement provides greater circumferential tolerance at these "home positions"; i.e., greater ease of manual adjustment. The circumferential extent of any of the separate contact segments may be varied in manufacturing for any secondary reasons.

Under each of these contacts is a substantially centrally-located hole of small size (approximately 1 millimeter) in relation to the area of the contact. Such holes are preferably drilled before the metal contacts are electroplated-on in known PCB manufacture. When the assembly is completed these holes become conductors 6 extending from the bottom of the contacts to the opposite side of the PCB board. These hole-contacts are also made to both circular contacts 2 and 3.

Separate substrate 8 is typically a thin disc having a diameter approximately equal to the outer diameter of the outer ring of contacts 5. This disc is of a refractory ceramic material such that electrical resistive paths 9 can be fired on it in the known manner of the electrovitreous art.

During manufacture the numerous holes 6 become filled with solder in the fabrication of the whole PCB, or as a specific step, if needs be.

Subsequently, substrate 8 is positioned against conductors-in-the-hole 6, with the resistor side in contact with the conductors, which extend out of the hole with a small "button" of solder. The positioning together is typically accomplished by laying the substrate on top of the PCB in an oven.

The substrate is oriented circumferentially to place the desired resistor paths 9 between the intended conductors 6.

The assembly is then re-heated sufficiently, say to 150 degree Centigrade (150° C.), to flow the solder at the various conductor 6 locations. A monolithic assembly is thereby obtained.

Figure 4:
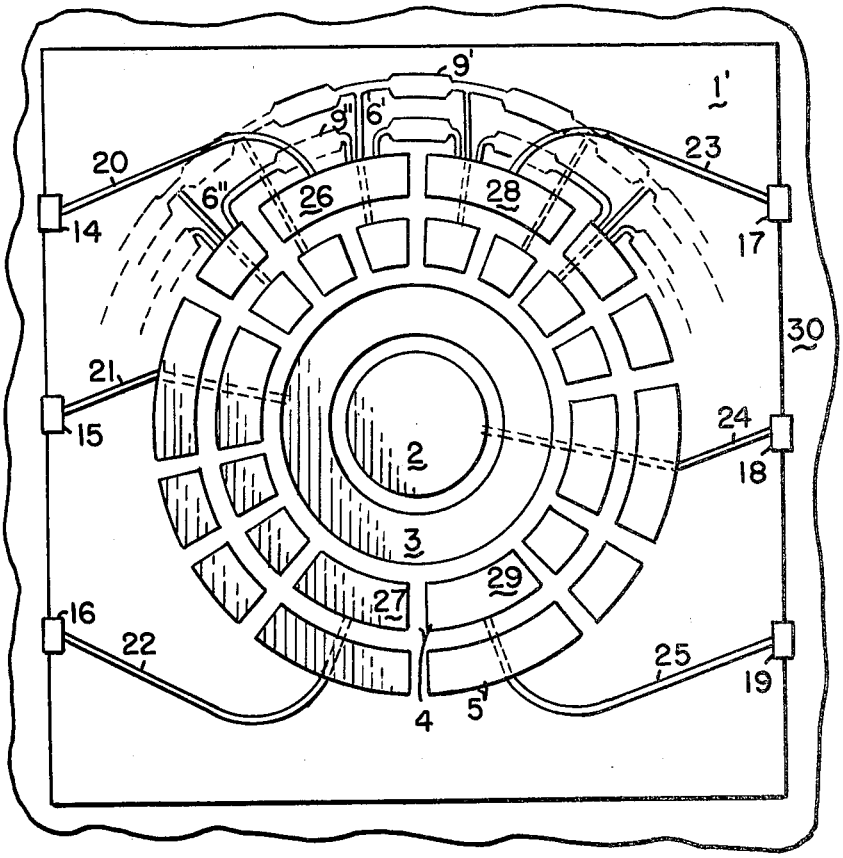
FIG. 4 is a top plan view of an alternate embodiment of the assembly, wherein the various elements are on one side of a refractory substrate.

The alternate embodiment of FIG. 4 has the feature that all of the operative structure is on one side of a ceramic refractory piece 1' and two pieces need not be functionally joined, as is required at 1 and 8 in FIG. 2 of the original embodiment. The term ceramic includes various refractory materials that can be glazed and fired at a temperature of up to 370° C. This includes alumina.

The ring structure may be the same as in FIG. 1. The plural fully circular electrically conductive contacts 2 and 3 are the same as before. Outer annular rings 4' and 5' may be exactly the same as rings 4 and 5 before. However, they are shown in FIG. 4 with four double-width segments to give a different resistive control. These choices and the ohmic value of resistances 9' may be varied widely. The inventive structure remains the same.

Electrical resistive paths, 9', 9'', etc. typically surround ring 5'. These are electrically connected to adjacent contacts in ring 5' by conductive means 6', 6'', etc. The shape, length and width of the resistive paths may vary as may be required to obtain the ohmic value of resistance desired at various points around the whole circumference of ring 5'.

The resistive paths are typically silk-screened on the substrate and then are fired at approximately 370° C. to form a permanent resistor element. in addition to varying the resistance by the geometry of the paths, different grades ink of inherently greater or lesser resistivity may be used.

The conductive paths are similarly silk-screened. An ink with a metallic content is used. The ink contains metallic particles, which fuse together when the ink is fired.

When conductors are required to extend through spaces that are occupied by contacts, the conductors are fired on first. Then an insulating glaze having a glass composition is fired on. Lastly, the contacts are silk-screened on and fired. The buildup of thickness is negligible.

Certain external electrical connections, 20–25, extend from various contacts to the periphery of ceramic piece 1'.

Conductor 20 extends from outer ring separate contact 26 to external circuit contact 14. Conductor 21 extends from circular contact 3 to external contact 15. In so doing it passes under rings of contacts 4' and 5'. This is accomplished with the insulating glaze layer separating the conductor from the rings structure that has been described above.

Similarly, conductor 22 extends from separate contact 27 to external circuit contact 16. Conductor 23 extends from outer ring separate contact 28 to external circuit contact 17. Conductor 24 extends from inner circular contact 2 to external circuit contact 18. Conductor 25 extends from inner ring separate contact 29 to external circuit contact 19.

Figure 5:
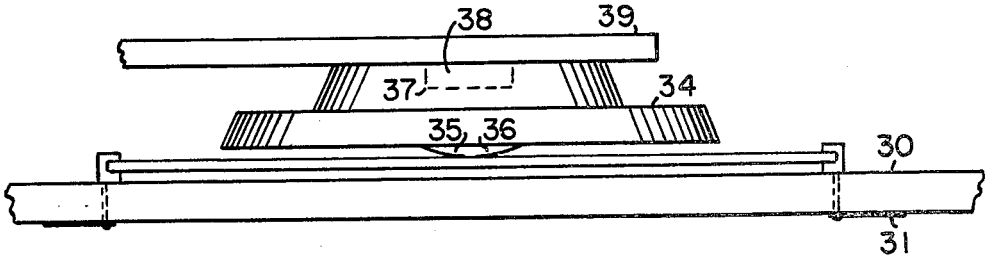
FIG. 5 is an end-on elevation view of the same.

Each of the external circuit contacts may be a Burg clip or equivalent, which rigidly fastens to both sides and an edge of ceramic piece 1'. See FIGS. 4 and 5. Each clip has a pin, as seen in FIG. 5, that extends through PCB 30. These are typically soldered in place in the board, and to a further external circuit 31 that contacts the same.

In order that rotary contact can be made with the several rings and separate contacts an insulative knob assembly employing knob 34 is employed. The knob carries two pairs of beryllium copper springs having palany wire tips 35, 36 that contact inner rings 2 and 4'. Other electrically separate springs with tips are spaced at a greater radius than springs 35 and contact outer rings 3 and 5'.

This arrangement of rings and rotary contact springs gives two separate circuits that can be varied in resistance at the same time. One use for the same is to alter the volume of stereophonic music. This may be in an airplane installation and the variable resistor disc assembly herein described may be located within the arm of the seat occupied by a passenger.

Insulative knob 34 may be journaled for rotation by having indentation 37 coaxially disposed, into which boss 38 of housing 39 fits. Housing 39 is shown in part in FIG. 5. It is shaped to allow knob 34 to be rotated by a finger of a person exerting a force at the periphery of the knob.

An insulated shaft-journal arrangement passing through the center of circular contact 2 with a journal attached to PCB 30 may alternately be utilized.

Figure 6:
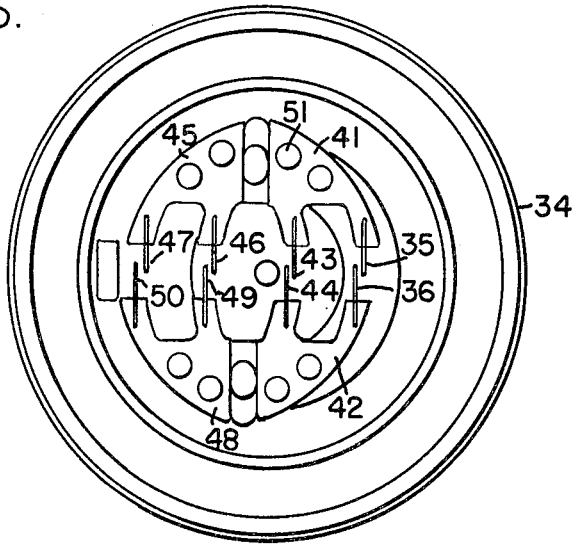
FIG. 6 is a bottom plan view of a rotor-wiper assembly.

A bottom plan view of the rotor assembly is shown in FIG. 6. Springs 35, 36 in FIG. 5 are generic. Wire tip 35 is brazed to beryllium copper spring 41, and likewise tip 36 to spring 42. These two tips ride upon ring 4'. Also attached to spring 41 is tip 43, and to spring 42 is tip 44. These tips ride upon ring 2.

Similarly, spring 45 is insulatingly attached to knob 34 and carries tips 46 and 47. Further spring 48 is likewise attached to knob 34 and carries tips 49 and 50. Tips 46 and 49 ride upon ring 3 and tips 47 and 50 ride upon ring 5'.

Each spring is securely fastened to knob 34 by two drive screws suited to thread into plastic, as screw 51. As an alternate embodiment knob 34 may have an equivalent number of bosses and the springs matching holes with clinching tabs arranged to dig into the bosses upon installation.

Any range of resistance values less than approximately $0.5\times10^6$ ohms may be deposited and fired upon the substrates herein. However, one embodiment for stereo music volume control service employs resistors of successively increasing resistance starting with 116 ohms and ceasing with 11,475 ohms.

Since all of the operative structure of the embodiment of FIG. 4 is on one side of a ceramic piece, the other "vacant" side may be used for additional useful purposes.

This may include "foreign" wiring; that is, wiring that is required on the PCB but which is not related to the wiring of the subject variable resistor. Such wiring is normally on the PCB, but could be on the vacant side of the ceramic piece.

Figure 7:
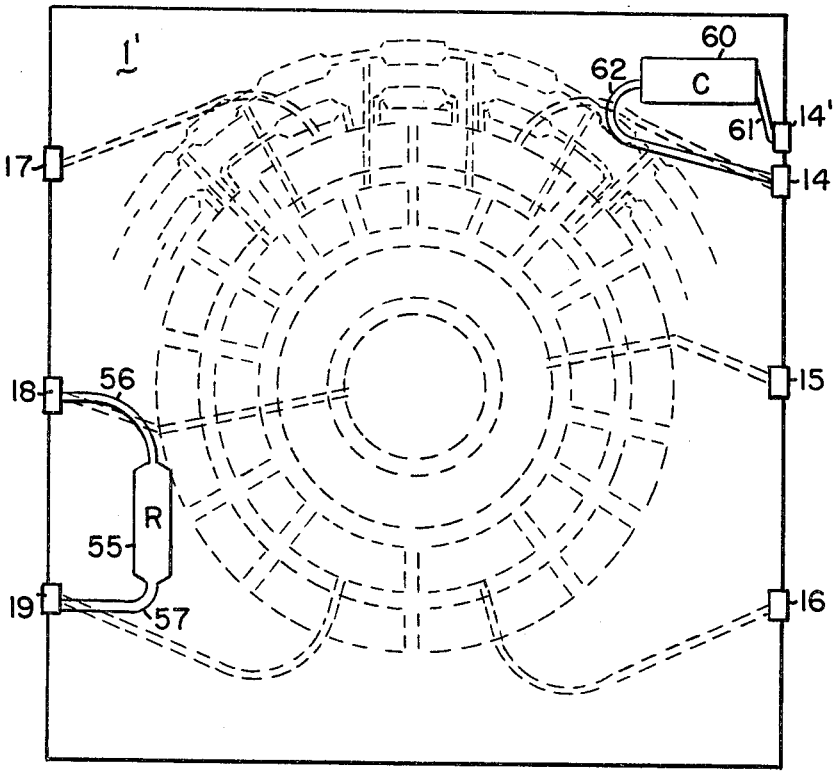
FIG. 7 is a fragmentary bottom view of an alternate assembly of FIG. 4, with further circuit components added.

FIG. 7 shows circuit components on the opposite side of the ceramic piece 1' from that occupied by the rotary variable resistor structure.

Resistor 55 is illustrative, and by conductors 56 and 57 is connected to clips 18 and 19.

Capacitors can be formed upon ceramic pieces that can be fired. This is according to techniques set forth above. Capacitor 60 is illustrative. In the volume control embodiment of this invention it may be employed in series with the variable resistor circuit to block direct current. This enhances the fidelity of a loudspeaker in the circuit (not shown). For this purpose an external circuit connection is made to a new clip 14'. Conductor 61 connects the capacitor to clip 14' and conductor 62 connects the capacitor to clip 14 and thence to the resistors of the rotary variable resistor assembly.

Figure 3:
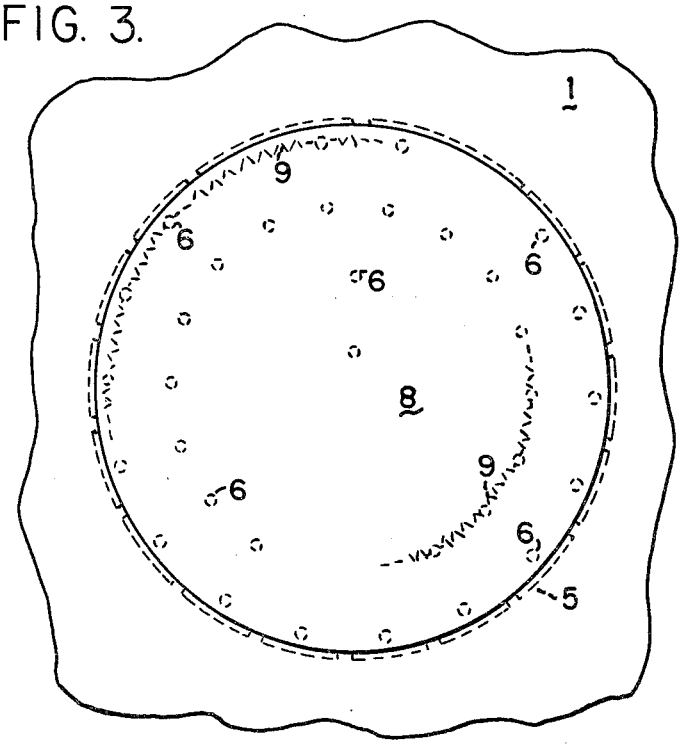
FIG. 3 is a bottom plan view of the assembly.

Other resistors and capacitors may be included, and connections may be made directly to the annular contacts, and others, by using the through-hole conductors 6 as shown in FIGS. 2 and 3.

Particularly in FIG. 4, the dotted portions of such conductors as 21 and 24 signifies that these conductors have been laid down first, fired, and the insulating glaze previously mentioned has been fired thereover. The ring of contacts 4, 5, etc. are then laid down and fired.

Typically, the circle of fixed contacts, as 4 or 5, is complete. However, this configuration is not required in the practice of the invention; the contacts may extend only over a part of the circumference.

Size is not a limiting parameter in the practice of this invention. A typical size is approximately 2 cm. for the diameter of the outer annular ring 5 or 5'. The drawings herein are enlarged several time thereover for clarity.

We claim:

1. A rotary variable resistor, comprising;

(a) an insulative planar element (1 or 1') having opposed parallel surfaces, (b) plural circular electrically conductive contacts (2,3) coplanarly upon a said surface, (c) plural concentric annular conductive rings (4,4',5,5'), having multiple separate contacts surrounding said plural circular contacts coplanarly upon a said surface, (d) electrically resistive paths (9 or 9') planarly structurally integral with said contacts and rings, upon a said surface, (e) conductive means (6 or 6'), planarly upon a said surface of said planar element electrically connecting said separate contacts of said annular rings to said resistive paths, and (f) means for rotatively contacting (35,36,43,44,46,49,47,50) at least one of said circular contacts (2,3), and for simultaneously selectively contacting at least one ring of said separate contacts (4,4' or 5,5').

2. The rotary variable resistor of claim 1, which includes;

(a) an electrically conductive element (6) passing through said planar element (1) from each of said contacts to the opposite surface of said planar element, and (b) a separate substrate (8), having electrical resistive paths (9) electrically connecting plural said electrically conductive elements (6).

3. The rotary variable resistor of claim 2, in which;

(a) the electrically conductive elements are formed of a fusible conductor, and (b) said substrate is attached to said insulative planar element by said fusible conductor monolithically joining said electrically conductive elements to said electrical resistive paths.

4. The rotary variable resistor of claim 1, in which said insulative planar element (1') comprises;

(a) a ceramic surface for receiving electrically conductive areas, having;

(1) plural circular electrically conductive contacts (2,3) upon said surface, (2) plural concentric annular conductive rings (4',5') having multiple separate contacts surrounding said plural circular contacts upon said surface, (3) electrically resistive paths (9') upon said surface, and (4) conductive means (6') upon said surface electrically connecting said contacts of said annular rings to said resistive paths.

5. The rotary variable resistor of claim 4, which additionally includes;

(a) external circuit contacts (14–19) exteriorly disposed relative to said annular conductive rings, and (b) further conductive means (20–25) electrically connecting selected said external circuit contacts to said plural circular electrically conductive contacts (2,3), and to selected said multiple separate contacts.

6. The rotary variable resistor of claim 1, in which;

(a) said electrically resistive paths (9 or 9') are connected in series, one to another, in a separate group for each of said plural concentric annular conductive rings (4,5 or 4',5').

7. The rotary variable resistor of claim 1, in which said means for rotatively contacting comprises;

(a) at least one spring contact (41) formed to electrically contact one of said circular contacts (2), and to also simultaneously selectively contact one of said ring of separate contacts (4'), and (b) at least one spring contact (45) formed to electrically contact another of said circular contacts (3), and to also simultaneously selectively contact another of said ring of separate contacts (5').

8. The rotary variable resistor of claim 4, which additionally includes;

(a) a circuit component (55 or 60) upon said ceramic surface, and (b) at least one conductive means (61 or 56) to connect said circuit component to said variable resistor.

9. The rotary variable resistor of claim 8, in which;

(a) said circuit component (55 or 60) is disposed on the side opposite to the surface carrying said variable resistor.

10. The rotary variable resistor of claim 8, in which;

(a) said circuit component (55 or 60) is disposed on the same side as the surface carrying said variable resistor.

11. The rotary variable resistor of claim 8, in which;

(a) said circuit component (55) is a resistor.

12. The rotary variable resistor of claim 8, in which;

(a) said circuit component (60) is a capacitor.

* * * * *